United States Patent [19]

Paton et al.

[11] 4,177,058

[45] Dec. 4, 1979

[54] METHOD FOR PRODUCING A NON-SPLIT METAL WORKPIECE FORMED AS A CAST HOLLOW BILLET WITH A BOTTOM PART

[75] Inventors: Boris E. Paton; Boris I. Medovar, both of Kiev; Georgy E. Tsukanov, Moscow; Alexei G. Bogachenko, Kiev; Viktor L. Artamonov, Kiev; Grigory A. Timashov, Kiev; Jury P. Shtanko, Kiev; Alexandr M. Marchenko, Kiev; Boris B. Fedorovsky, Kiev; Ilya I. Kumysh, Kiev; Anatoly D. Chepurnoi, Zhdanov Donetskoi oblasti; Vladimir Y. Saenko, Kiev; Gennady M. Semin-Vadov, Moscow, all of U.S.S.R.

[73] Assignee: Institut Elektrosvarki Imeni E.O. Patona Akademii Nauk Ukrainskoi SSR, Kiev, U.S.S.R.

[21] Appl. No.: 845,679

[22] Filed: Oct. 26, 1977

[30] Foreign Application Priority Data

Sep. 22, 1977 [SU] U.S.S.R. ..... 2520640

[51] Int. Cl.[2] ..... C22B 4/00; B22D 27/02

[52] U.S. Cl. ..... 75/10 C; 75/10 R; 164/50; 164/52; 164/250; 164/252

[58] Field of Search ..... 75/10 R, 10 C; 164/50, 164/52, 250, 252

[56] References Cited

U.S. PATENT DOCUMENTS

| | | | |
|---|---|---|---|
| 3,752,215 | 8/1973 | Torikai | 164/52 |
| 3,807,485 | 4/1974 | Paton | 164/52 |
| 3,807,486 | 4/1974 | Paton | 164/52 |
| 3,894,574 | 7/1975 | Paton | 164/52 |

*Primary Examiner*—Peter D. Rosenberg
*Attorney, Agent, or Firm*—Fleit & Jacobson

[57] ABSTRACT

Premelted slag and metal of a specified composition are poured into a receptacle. Thereafter, electroslag remelting of consumable electrodes is carried out in a slag pool formed in the receptacle. As the poured-in metal and remelted metal solidify, a non-split workpiece is being formed of two parts, of which one part is formed of the poured-in metal and the other one of the consumable electrode being melted down. To produce hollow billets with bottom parts according to the method, described above, the molten metal is taken in an amount determined by the mass of the bottom part. The molten slag and molten metal are poured into a working space of an apparatus for producing cast hollow billets, which working space is defined by a stationary bottom plate, the mould walls and by a mandrel. This very working space is also used for effecting electroslag remelting of consumable electrodes to form the remainder part of the hollow billet.

15 Claims, 14 Drawing Figures

METHOD FOR PRODUCING A NON-SPLIT METAL WORKPIECE FORMED AS A CAST HOLLOW BILLET WITH A BOTTOM PART

BACKGROUND OF THE INVENTION

1. Field of the Invention

The present invention relates to metallurgical practice, and more particularly to a method and apparatus for producing a non-split metal workpiece formed as a cast hollow billet with a bottom part.

The invention can find most utility in the production of shaped castings to be employed in heavy machine-building industry, as well as in the production of thick-wall pipes, vessels, fittings, etc.

2. Description of the Prior Art

The problem of producing profile billets of practically any shape has been long solved in metallurgy by means of conventional casting techniques. However, electroslag metallurgy attracts great interest of those skilled in the art, since it ensures high quality of metal being thereby produced, and makes it possible to utilize this process for the manufacture of special-purpose articles.

Until recently the problem in question has found but partial solutions.

For example, there is known in the art a method of casting hollow billets formed with a bottom part, comprising the steps of premelting slag, pouring it into a mould of an apparatus for producing cast hollow billets formed with bottom parts, and subsequent electroslag remelting of consumable electrodes in a working space of said apparatus. (cf. "Elektroshlakovoye lityo", NIIMASH Review, series IV, Moscow, 1974, pp. 36–38, FIG. 22δ). This method starts with forming the bottom part and subsequently the walls of a billet.

An apparatus for producing a hollow billet with a bottom part by the above method /ibid./ comprises a mould mounted on a bottom plate, a mandrel mounted for vertical movement in the mould cavity so that a portion of the cavity adjacent the mould walls and a working surface of the bottom plate remains vacant forming a working space, and consumable electrodes positioned within the working space.

The foregoing method producing a cast hollow billet with a bottom part and the apparatus for practicing this method are efficient in casting billets of relatively small diameter and small ratios of this diameter to wall thickness (less than 10:1). With larger values of the diameter to wall thickness ratio, the electrodes will be spaced far away from the central portion of the bottom part to enable normal thermal conditions in this area of the slag pool, which impairs the formation of the billet bottom surface and results in poor quality of the bottom part metal, caused, in particular, by slag particles being entrapped therein.

A non-uniform temperature field created in the process of casting hollow billets according to this method prevents also the production of complex-shaped bottom parts. Moreover, it is impossible to substantially raise the metling rate of the electroslag process and, accordingly, to increase the rate of production of billets.

The design of the foregoing apparatus for producing a cast hollow billet with a bottom part, which contemplates the process to be carried on in a stationary mould confines its application only to making billets of a relatively short length.

Widening the range of the billet lengths by using a conventional movable mould would entail a considerable complication of the apparatus design because of installation of an additional drive which is imperative in this case, for it is advisable to start moving the mandrel prior to moving the mould to avoid blocking of the mandrel by the solidified metal, especially when producing a hollow billet with a shaped bottom part.

In view of the fact that the problem of producing shaped castings by electroslag method has not yet found its complete solution, a combined technological process has been introduced, comprising various methods of producing separate parts intended for ultimate production of a non-split workpiece of complex configuration. For example, there is known in the prior art one of the most advanced methods for the production of non-split workpieces of complex configuration, which comprises mounting of separate ready-made parts of a workpiece in a shaped mould, and subsequent electroslag remelting of consumable electrodes in the same mould to thereby form the remainder part of the said workpiece and to fuse said ready-made parts thereto (cf. U.S. Pat. No. 3,894,574, U.S. Class 164-52).

The prior art method described above makes it possible to produce workpieces of practically any size and shape, having the advantages of billets produced by the electroslag method (ready-made articles can be obtained by any conventional method, inclusive of electroslag remelting of consumable electrodes).

The method referred to above can be regarded as a successful attempt to solve the above-mentioned problem in general, which makes it possible to produce such complex-shaped articles as crankshafts.

However, this method is relatively complicated in that it requires the supply of ready-made parts for the article to be produced, which involves substantial expenses for the manufacture of such articles. This being the reason for the development of a simple and efficient method for producing shaped billets required for the manufacture of articles less complex in shape than those mentioned above.

SUMMARY OF THE INVENTION

The primary object of the present invention is to provide a simple and effective method for producing a non-split metal workpiece of complex configuration.

Another object of the invention is to provide a highly efficient method for the production of a metal workpiece.

Still another object of the invention is to provide a method which enables the production of non-split workpieces from separate parts of different chemical compositions.

More specifically, an object of the invention is to provide a method for producing a cast hollow billet with a bottom part, which enables the workpiece to be produced with specified properties of metal of the bottom part, with a workpiece having practically any outer diameter of the billet and any ratio of this diameter to the thickness of the billet wall.

Yet another object of the invention is to provide a method for producing a cast hollow billet with a bottom part of any specified shape.

Another object of the invention is to provide a simple in construction apparatus for the production of a cast hollow billet which enables the production of a cast hollow billet in accordance with the method of the invention.

According to the invention, a method of producing a metal workpiece comprises the steps of premelting a metal required for one part of said workpiece, pouring the molten metal into a receptacle, premelting slag and its subsequent pouring into the same receptacle, electroslag remelting of consumable electrodes to thereby form the other part of the workpiece and having said part bonded with prefed metal, wherein, the metal required for forming the first said part of the workpiece is fed to the receptacle in a molten state so that the metal obtained by electroslag remelting of consumable electrodes flows upon the metal prepoured into the mould cavity and partially solidified therein.

The method of the invention is more simple than conventional methods in that it enables bonding between the metal required for forming one part of the workpiece and the metal required for another part of said workpiece to take place at an early stage of production of the first said part.

As a result, it becomes possible to render the process of producing a metal workpiece less arduous as a whole, to reduce power input and cut down expenses involved as compared to the production processes known in the art; hence higher rate of production of said workpieces.

Where a metal workpiece being produced is formed as a hollow billet with a bottom part, it is preferable that prior to electroslag remelting of consumable electrodes molten metal should be poured into a working space of an apparatus for producing a cast hollow billet along with molten slag, wherein a hollow billet is formed, the composition of said metal being similar to that specified for the metal of the billet bottom part and the amount of said metal being determined by the optimal conditions required for forming the bottom part and its shaping.

The method according to the invention for producing the billets described above is advantageous over the prior-art methods in that it enables the production of billets of practically any diameter and of any diameter-to-wall-thickness ratio. It also permits bottom parts to be formed of practically any shape, with the structure of metal and its chemical composition complying with the highest standards. This acquires especial importance in the case of production of pressure vessels and of those intended for storing various agressive media.

Where strictly specified contents of suphur and nonmetallic inclusions are to be observed in the metal of the hollow billet bottom part or in that of the shaped part of the solid billet, molten metal is preferably poured into the receptacle prior to molten slag.

If stringent requirements are imposed upon the gas content in the metal, the molten metal and molten slag are preferably poured in simultaneously.

To protect the metal from oxidation and to increase its residence time in slag, the latter having refining effect on the former, moltem metal and molten slag are preferably poured in one and the same jet. Also to protect the metal from being oxidized by the air, it is good practice that the jet of molten metal or of the same metal combined with molten slag be shielded by a neutral gas as they are poured into the receptacle of an electroslag casting apparatus.

To improve the quality of metal which forms one part of a workpiece, its bottom part in particular, molten metal and molten slag are preferably blown through with a gas within a receptacle while being poured therein. In this case gas bubbles, getting into molten slag and metal, absorb and carry away a portion of undesirable impurities encountered in the form of solid particles and in a gaseous state.

It is possible to pour molten metal over a dummy bar. This ensures stable temperature conditions of the electroslag process and, consequently, good quality of metal of the billet being produced.

Where a hollow billet with a bottom part is manufactured, the mass of molten metal poured in, or the mass total of said metal and that of the dummy bar, will be within the range of from 80 to 120% of the mass of metal required for forming the billet bottom part. When the amount of metal is less than 80% of the mass of the bottom part, it is impossible to create normal thermal conditions in the corresponding area of the working space of the apparatus for producing a cast hollow billet with a bottom part, which is essential for obtaining the bottom surface of an adequate quality.

The invention also provides the apparatus for producing a cast hollow billet with a bottom part, comprising a mould mounted on a bottom plate, consumable electrodes disposed in the upper section of the working space, and a mandrel mounted for vertical movement within the mould cavity so that a portion of said cavity adjacent the mould walls and the bottom plate working surface remains vacant when the mandrel is in the lowermost position and forms the working space, the mandrel is rigidly connected to the mould, which allows for their joint vertical movement in the process of electroslag remelting of consumable electrodes.

The apparatus is provided with a means for vertical movement of the mould and a means for pouring molten metal into the working space.

The apparatus of the above design for producing a cast hollow billet with a bottom part enables the production of billets having a relatively long length using for this purpose a smaller in size mould. Since the mandrel is made movable, its jamming is prevented while the billet metal solidifies. In carrying out the method of the invention into effect, it became possible to bring the initial movement of the mandrel in step with that of the mould due to high rate of pouring of molten metal, which allows for one common drive to be used, thereby rendering the apparatus more simple in construction.

The apparatus according to the invention for producing a cast hollow billet with a bottom part may incorporate at least one molten metal level gauge positioned in the proximity of the metal level being gauged and connected to a means for vertical movement of the mould to thereby carry out control over its movement depending upon the rate of metal solidification. The metal level gauge can be installed in the mould wall level with the metal being poured.

When the predetermined level of the metal being poured does not reach the level of the mould walls, it is advisable that the apparatus for producing a cast hollow billet with a bottom part be provided with two molten metal level gauges one of which is mounted in the bottom plate. In this case the gauge mounted on the bottom plate controls the level of molten metal being poured, while the gauge mounted in the mould wall controls the level of metal formed in the electroslag process.

To enable the blowing of gas through molten metal in the process of pouring, the apparatus bottom part is preferably formed with gas supply channels.

According to the invention, the bottom part of the cast hollow billet being produced is formed of a metal having chemical composition different from that of the metal of the remainder billet part. These types of billets can be, for instance employed in the manufacture of pipes by drawing. Where pipes are produced from costly metals containing, for instance titanium, nickel, or chromium, the bottom parts of such billets to be later discarded can be formed of the cheapest metal.

The billets of the construction described above are readily produced by the method of the invention while molten metal is poured into the receptacle in an amount and of a composition being the same as that of the billet bottom part, as well as by subsequent utilization of the process of the electroslag remelting consumable electrodes, with the composition and amount of their metal being the same as those of the metal of the remainder part of the billet.

BRIEF DESCRIPTION OF THE DRAWINGS

Other objects and advantages of the invention will become apparent from the consideration of embodiments thereof, with reference to the accompanying drawings, wherein:

FIG. 3 shows a mould with a flat bottom plate;

FIG. 4 shows a mould with a bottom plate, the working surface of which forms a recess and conforms to a portion of surface of the billet shaped bottom, a mandrel being disposed over the bottom plate;

FIG. 5 shows a mould with a bottom plate the working surface of which forms a recess and conforms to the entire surface of the billet shaped bottom, a mandrel being lowered into the bottom plate recess.

FIG. 6 shows a mould with a bottom plate the working surface of which forms a recess, a mandrel being positioned level with the bottom plate;

FIG. 11 shows a billet with an expanded top part;

FIG. 12 shows a billet formed with one branch part;

FIG. 13 shows a billet formed with two branch parts;

FIG. 14 shows a billet with an expanded bottom part.

DESCRIPTION OF THE PREFERRED EMBODIMENTS

Figure 1:
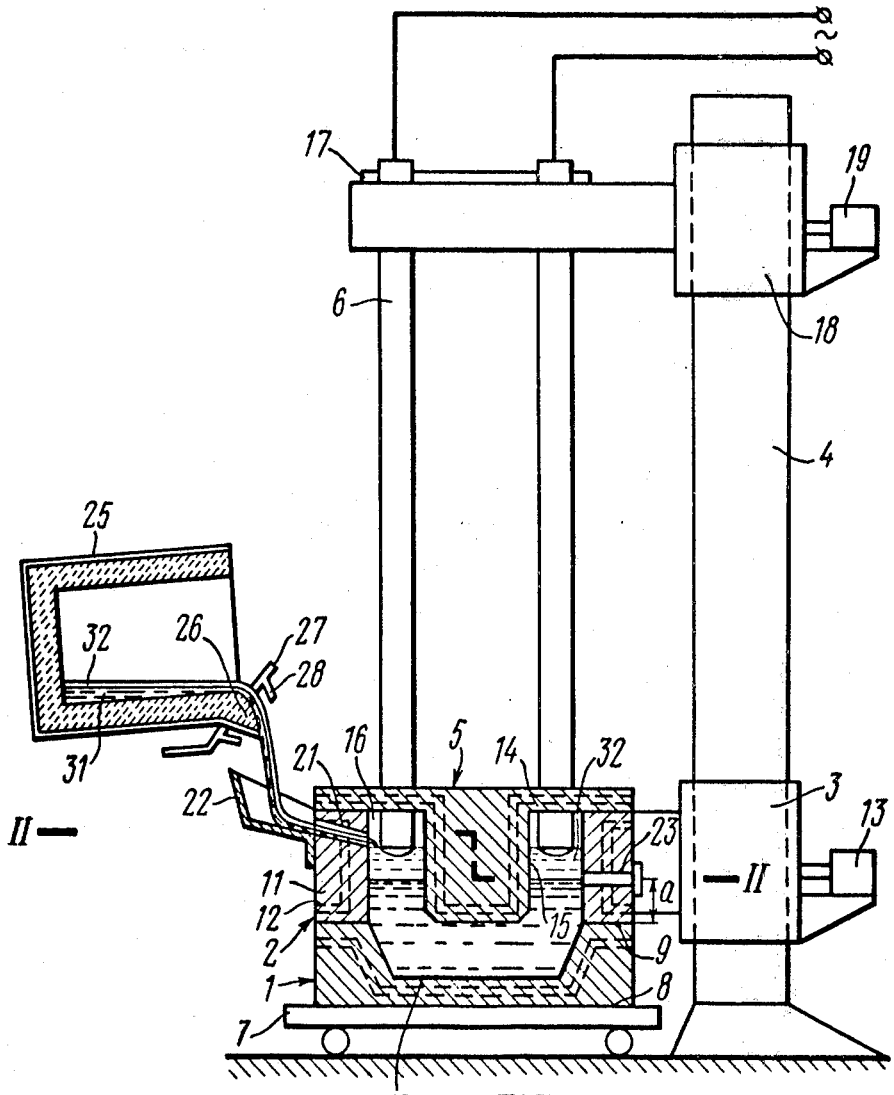
FIG. 1 is a longitudinal sectional view of an apparatus for producing a cast hollow billet with a bottom part, according to the invention; it also shows a ladle positioned for pouring molten slag and molten metal into a working space of the same apparatus, according to the method of the present invention for producing a cast hollow billet with a bottom part.

The method according to the invention for the production of a non-split metal workpiece made up of at least two parts is carried out in the following manner.

First, a metal of the same composition as that specified for the metal of one of the workpiece parts is premelted by any conventional method in a metal melting apparatus such as open-hearth furnace, electric arc furnace, induction furnace, electroslag furnace, or oxygen converter. Next, slag is premelted in the same furnace or, if impossible, in a separate slag melting furnace in an amount sufficient to form a slag pool. Thereafter, the molten metal and slag are poured into a receptacle. The pouring of the former and the latter is carried out either simultaneously or successively: first, molten slag and then molten metal. The selection of the pouring variant will depend upon the requirements placed on the metal used for the corresponding part of the workpiece being produced. For example, where gas content in the metal is of primary importance, the simultaneous pouring will be preferred.

The pouring of molten slag and metal successively one after the other permits of removing sulphur and non-metallic inclusions from the metal being poured.

In the preferred embodiment of the invention, a jet of molten metal alone or a jet of both molten metal and slag is blown with a neutral gas, such as argon to protect the metal from oxidation.

In addition, the molten metal is blown through with the same argon gas within the receptacle into which it is poured, whereby the contents of gases, injurious admixtures, and non-metallic inclusions are lowered in the metal.

Upon pouring the molten slag and metal into the receptacle, electroslag remelting of at least one consumable electrode is initiated in the slag pool formed therein. The molten metal resultant from the melting down of consumable electrode flows upon the metal poured into the receptacle. As the metal solidifies, a non-split workpiece is being formed in the receptacle. One part of said workpiece is formed from the poured-in metal, whereas the other one, from the remelted metal off the consumable electrode, the composition and mass of which are selected in accordance with the composition and mass specified for the metal of said other part of the workpiece.

According to one embodiment of the invention, molten metal is poured simultaneously with molten slag over a dummy bar. Heated up by the heat of the poured-in molten metal, the metal of the dummy bar is partially melted and the latter is thus fused with the workpiece part disposed thereabove.

The method according to the invention for producing a non-split metal workpiece made up of at least two parts will be better understood from the description of one embodiment thereof, whereby a hollow cast billet with a bottom part is produced, said method being carried out into effect with the aid of an apparatus described hereinbelow.

An apparatus for producing a cast hollow billet with a bottom part comprises a stationary bottom plate 1 (FIG. 1), a mould 2 mounted on a carriage 3 which is movable along a vertical column 4, a mandrel 5 rigidly connected to the mould 2, and consumable electrodes 6.

The stationary bottom plate 1 is positioned on a trolley 7 with its base plane 8. The trolley 7 which is kept in a fixed position is intended for removing the finished billet.

At the top, the bottom plate 1 is formed with a bearing surface 9 intended for positioning the mould 2 thereon at the initial stage of operation of the apparatus and a working surface 10 intended for forming the outside surface of the billet bottom and having appropriate shape and size. The stationary bottom plate 1 is cooled.

Figure 2:
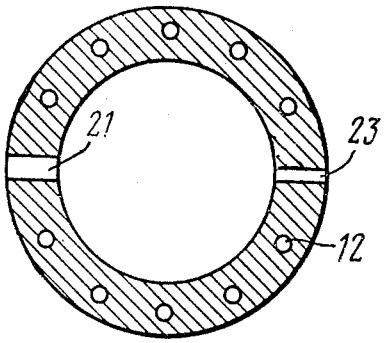
FIG. 2 is a cross section taken along the line II—II of FIG. 1.

The mould 2 has walls 11 forming a through cavity. In the lowermost position of the mould 2, this cavity is confined from underneath by the working surface 10 of the stationary bottom plate, wherein is formed a lower part of the billet. The walls 11 are cooled and provided with suitable passages 12 (FIG. 2) which are in communication with a coolant feed source (not shown).

The carriage 3 (FIG. 1) which carries the mould 2 on one side of the vertical column 4 is provided with a means 13, which is basically an electric or any other conventional drive, adapted to displace the mould 2 in the vertical and mounted on the opposite side of the same column.

According to one embodiment of the apparatus for producing a cast hollow billet with a bottom part the mandrel 5 is formed with a flange 14, by means of which it is secured on the mould 2, and with a billet forming section 15 inserted into said mould and adapted to form the interior of the billet. A part of the cavity of the mould 2 defined by the walls of the latter and the billet forming section 15 of the mandrel 5 and by the working surface 10 of the stationary bottom plate 1 and the said billet forming section 15 of the mandrel 5 is basically a working space of the apparatus for producing a cast hollow billet with a bottom part.

Figure 4:
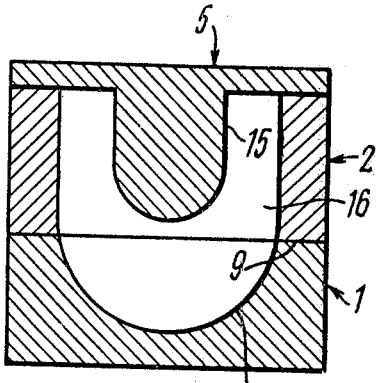
Figure 5:
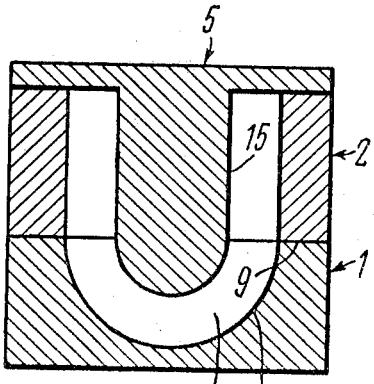

Depending on a billet bottom shape the extreme lower point of the billet forming section 15 of the mandrel 5 may be above (FIGS. 3, 4), below (FIG. 5), or level with (FIG. 6) the bearing surface 9 of the stationary bottom plate 1.

Figure 3:
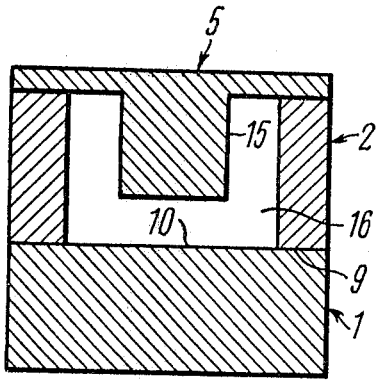
FIG. 3–6 are fragmentary sectional views illustrating various embodiments of the apparatus for producing a cast hollow billet with a bottom part according to the invention, with a mould being in the lowermost position.

As is shown in the drawings, this point of the mandrel 5 is above the stationary bottom plate 1 when the billet bottom is flat and shaped at the outside by the bottom plate working surface 10 which is level with the bearing surface 9 (FIG. 3).

An embodiment of the apparatus is intended for producing a billet with a bottom part having profiled inside and outside surfaces, being constructed so that a recess is formed in the stationary bottom plate 1 by the working surface 10 used partially or entirely (see FIGS. 4 and 5 respectively) for shaping the outside surface.

Figure 6:
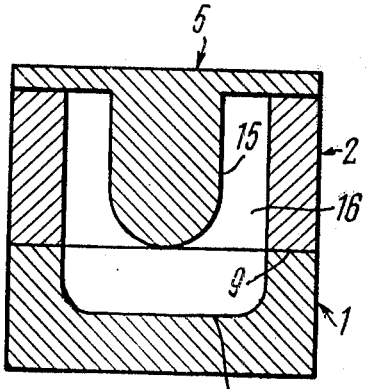

An embodiment of the apparatus shown in FIG. 6 is intended for producing a billet with a bottom part having a shaped inside and a rectangular outside surfaces. In this case the working surface 10 of the stationary bottom 1 forms a recess and the lowermost point of the billet forming section 15 of the mandrel 5 is level with the bearing surface 9 of the stationary bottom plate 1.

The mandrel 5 (FIG. 1) is cooled and has an appropriate cavity which is in communication with a coolant feed source.

The consumable electrodes 6 of the apparatus for producing a cast hollow billet with a bottom part are clamped in an electrode holder 17 mounted on one side of the vertical column 4 over the mould 2 in an upper carriage 18 movable along the vertical column 4. On the opposite side of this column, an electrode feed means 19 is mounted on the upper carriage 18 which means is similar in design to the means 13 adapted to displace the mould 2 in the vertical or constructed in any other conventional manner. The consumable electrodes 6 are solid and evenly spaced in the upper portion of the working space 16.

An embodiment of the apparatus for producing a cast hollow billet with a bottom part, provided with a single solid or tubular consumable electrode 20 (the latter shown in FIG. 7) is also possible.

According to the invention, the apparatus comprises a means for pouring molten metal and molten slag, which means includes a channel 21 (FIG. 1) formed in the mould wall 11. The channel 21 is arranged between the cooling passages 12 (FIG. 2) and communicates at entry with a chute 22 for directing the liquid jet (FIG. 1) and at exit with the working space 16.

Figure 8:
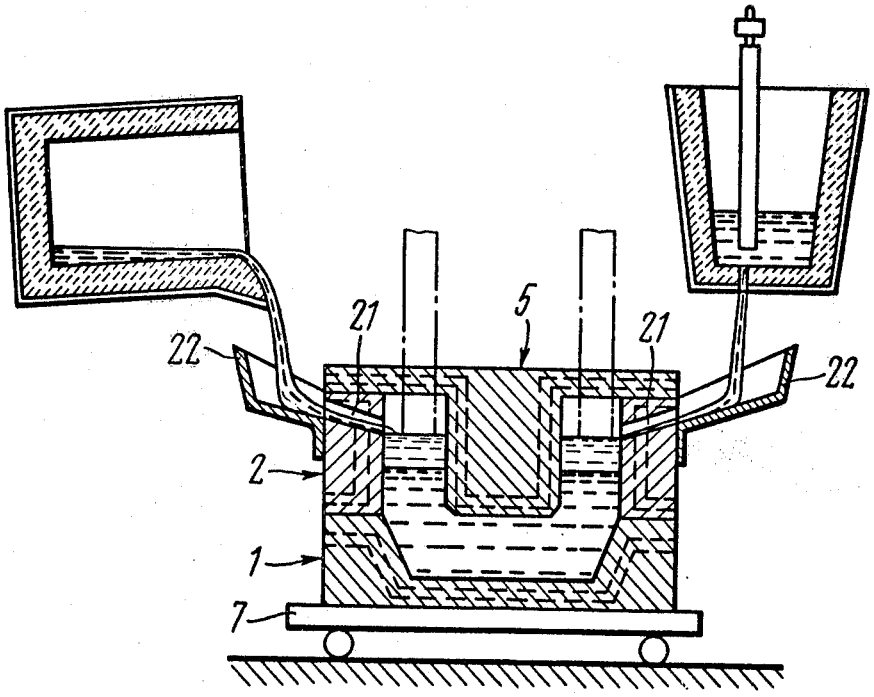
FIG. 8 is a fragmentary view of an embodiment of the apparatus for producing a cast hollow billet with a bottom, having two channels for pouring molten metal and slag, also illustrating a modification of the method according to the invention, wherein molten slag and molten metal are poured from different metal containers.

Another embodiment of the apparatus according to the present invention is possible, wherein the means for pouring molten metal and molten slag includes two channels 21 (FIG. 8), one of them serving for pouring molten metal and the other for pouring molten slag. In this case, accordingly, there are two chutes 22.

A molten metal level gauge 23 is also mounted in the mould wall 11 (FIG. 1). In the embodiment of the apparatus shown in FIG. 1 the molten metal level gauge 23 is mounted at a distance "a" from the mould lower butt end, which distance corresponds to a predetermined level of molten metal poured into the mould 2 when the latter is in the lowermost position and rests on the bearing surface 9 of the stationary plate 1.

The gauge 23 is electrically (or in some other way) connected to the means 13 adapted to displace the mould 2 in the vertical.

Figure 9:
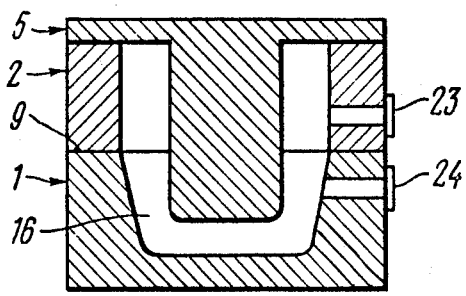
FIG. 9 is a fragmentary view of an embodiment of the apparatus for producing a cast hollow billet with a bottom part, having an additional molten metal level gauge mounted in a bottom plate.

In another embodiment of the invention shown in FIG. 9, besides the molten metal level gauge 23 mounted in the mould wall 11, there is one more molten metal level gauge 24 mounted in the stationary bottom plate 1 and connected to the means 13 for vertical displacement of the mould 2. This embodiment of the apparatus according to the invention is possible on condition that at least a portion of the working surface 10 of the stationary bottom plate 1 is below the level of the bearing surface 9 and is expedient only in the cases when the level of metal poured into the working space 16 does not rise above the bottom plate recess. In this case the gauge 23 serves only to control the level of molten metal obtained in the electroslag process, whereas in the embodiment shown in FIG. 1 this gauge also serves to control the level of metal poured into the working space 16.

FIG. 1 shows, in the pouring position, a ladle 25 for simultaneously pouring molten slag and molten metal. The open end of the ladle 25 is provided with a lip 26 for directing the molten slag and molten metal jet. Said lip 26 is surrounded by an annular collector 27 the cavity of which is in communication with a neutral gas feed source (not shown). Communicating with the same cavity are pipes 28 arranged on the annular collector butt end on the side remote from the major volume of the ladle 25. The annular collector 27 is rigidly secured to the ladle 25 at such an angle that the pipes 28 are inclined to the liquid jet when this ladle is inclined for pouring molten slag and molten metal.

Figure 10:
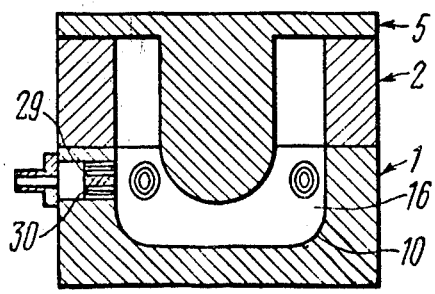
FIG. 10 is a fragmentary view of an embodiment of the apparatus for producing a cast hollow billet with a bottom part, the bottom plate of the apparatus being provided with channels for feeding a gas during the pouring of metal.

FIG. 10 shows an embodiment of the apparatus for producing a cast hollow billet in which the stationary bottom plate 1 is provided with a row of plugs 29 arranged around the periphery thereof and formed with open horizontal passages 30 for feeding a gas into the working space portion which is bounded by the working surface 10 arranged substantially below the level of the bearing surface 9.

The method of producing hollow billets with a bottom part according to the present invention is accomplished in the foregoing apparatus as follows:

Molten metal having a chemical composition similar to that specified for the billet bottom part is premelted in a melting unit such as an open electric arc furnace. In the same unit a slag pool is formed by one of conventional methods to produce molten slag suitable for use in the subsequent electroslag process described below.

Molten metal 31 (FIG. 1) and molten slag 32 so produced are poured into the working space 16 of the foregoing apparatus for producing a cast hollow billet with a bottom part through the chute 22 and the channel 21 in the wall 11 of the mould 2 which is in the lowermost position and rests on the bearing surface 9 of the stationary bottom plate 1.

The pouring is carried out either directly from a melting unit if its size and design permit of it (e.g., if it is a small electric arc furnace) or, as shown in FIG. 1, with the use of the ladle 25 into which molten slag and molten metal are previously poured.

In the preferred embodiment of the method the molten metal and molten slag jet is also shielded by blowing a neutral gas, such as argon, about it, said gas being fed towards the jet through the annular collector 27 and the pipes 28 communicating with its cavity.

The amount of molten metal 31 to be poured is selected within the limits of 80 to 120% of the billet bottom part mass depending on the bottom part shape. Thus for billets with a bottom tapering downwards, the amount of molten metal poured into the working surface approaches the lower of the limits mentioned above, for instance, in those cases when such a shape of the billet makes it necessary to bring the lower portion of the billet forming section 15 of the mandrel 5 below the level of the bearing surface 9 of the stationary bottom plate 1 and into the recess formed by the working surface 10 of this bottom plate (see FIG. 9). The amount of molten metal poured into the working space 16 approaches the upper of said limits mostly when producing billets with flat bottom parts (an embodiment of the apparatus which comprises the mandrel and the bottom plate of the shape corresponding to the billet with a flat bottom part is shown in FIG. 3). If said upper limit is exceeded, the mandrel may be squeezed by the crystallized metal. The pouring of metal in an amount of less than 80% of the bottom metal mass may result in an inadequate heating of metal in the centre of the working space lower portion during the subsequent remelting of the consumable electrodes 6 for building up the rest of the billet and, consequently, in an inadequate inside surface of the bottom.

The level of metal being poured is controlled by the gauge 23 mounted in the mould wall 11 when this level is above the bearing surface of the stationary bottom plate 1.

In the embodiment of the invention, wherein molten metal is poured in an amount less than the bottom mass (FIG. 9) the level of metal being poured is controlled by another gauge 24 mounted in the stationary bottom plate 1 at a suitable height.

In case stringent requirements are placed upon the billet bottom metal as to the contents of gas, sulphur, and non-metallic impurities, a gas, such as argon or an argon and oxygen mixture, is blown over molten metal poured into the working surface, the blowing being effected through the bottom plate 1 the design of which is shown in FIG. 10. The gas is fed into the cavity bounded by the working surface 10 of the stationary bottom plate 1 through the passages 30 of the plugs 29, said passages communicating with an appropriate gas feed source.

The amount of molten slag 32 poured into the working space 16 of the apparatus for producing a cast hollow billet with a bottom part is selected so as to agree with the slag pool volume which must be sufficient to provide for a stable electroslag process described hereinbelow and an optimum power consumption.

Upon pouring molten metal and molten slag into the working space 16 (FIG. 1) of the apparatus for producing a cast hollow billet with a bottom part, a conventional electroslag process of melting the consumable electrodes 6 is started therein, the chemical composition of the electrodes being similar to that specified for the billet part which is to be built up on the metal poured into the working space 16. The mass of the consumable electrodes should be sufficient for forming the remainder part of the billet.

By a signal from the gauge 23 or, in the embodiment of FIG. 9, from the gauge 24 the drive carriage 3 movable along the vertical column 4 starts moving upward the mould 2 (FIG. 1) together with the mandrel 5. The gauge 23 in both embodiments under consideration controls the molten metal level and correlates the rate of said movement with the crystallization rate of the deposited metal.

The movement is terminated upon completion of the electroslag process after the mandrel 5 is entirely brought out of the billet.

As the consumable electrodes are melted down during the electroslag process they are advanced by means of the upper carriage 18 movable along the vertical column 4.

If necessary, the electroslag process may be accompanied by a gas blowing using for this purpose plugs similar to the plugs 29 with passages 30 and disposed in the mould walls 11 (not shown).

Figure 7:
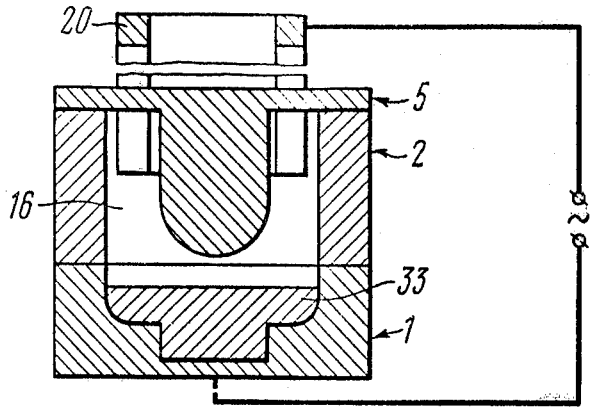
FIG. 7 is a fragmentary view of another embodiment of the apparatus for producing a cast hollow billet with a bottom part, having a tubular electrode, and also illustrates a modification of the method according to the invention, wherein a dummy bar is used at the initial stage.

FIG. 7 illustrates another embodiment of the method of the present invention the distinguishing feature of which consists in pouring prepared molten metal simultaneously with molten slag into the working space 16 over a dummy bar 33 placed on the stationary bottom plate 1. The dummy bar 33 is basically a piece of solid metal.

The embodiment of the apparatus for producing a cast hollow billet with a bottom part according to the present invention, employing a single electrode 20 is designed for practising this embodiment of the method. As shown in FIG. 7, in this embodiment one terminal of a power source is connected to the stationary bottom plate 1.

With such arrangement and in the absence of the dummy bar 33, a point contact is established between molten metal and the stationary bottom plate 1 caused by a slag coating on the bottom plate surface. With a high current density this may result in overheating and melting of the stationary bottom plate 1 at the place of contact.

The dummy bar 33 placed on the stationary bottom plate 1 prevents the formation of a slag coating on its surface, ensuring its intimate contact with metal poured into the working space 16 and, consequently, most favourable conditions for the current flow.

In the process of the aforesaid pouring and subsequent electroslag melting, the dummy bar 33 is fused to the overlying part of the billet being formed.

In this embodiment of the method the mass of molten metal to be poured is selected so that including the mass of the dummy bar 33 the amount of metal which is in the working space 16 prior to the onset of the electroslag process makes up 80 to 120% of the mass of the billet bottom like in the embodiment of the method of the invention in which no dummy bar is used, and for the same reasons. The dummy bar 33 may, in particular, be formed as a section of the bottom part of the billet and in this function be used independently of the circuit of the apparatus.

It should be noted that the foregoing method of producing a hollow billet with a bottom part may be practised using an apparatus of a different design than those described above. In particular, this apparatus may be provided with a stationary mould. In all cases, however, a movable mandrel is indispensable to carry out the method according to the invention.

Any of the above-described embodiments of the method according to the invention can be used for the production of hollow billets with bottom parts, intended for the manufacture of pipes by drawing with subsequent removal of the said bottom parts. Where special-purpose pipes are to be manufactured from expensive metals, the bottom parts of such pipes can be made of any other inexpensive material.

Therefore, the method according to the invention for producing a hollow billet with a bottom part, wherein the metal for forming the billet bottom part is obtained separately, will find most utility in the production of such types of billets. It is to be noted that the composition of the prepared molten metal being poured is similar to that specified for the metal of the billet bottom part, whereas the composition of the consumable electrodes used for producing the remainder part of the billet is similar to that specified for the metal of this part.

The method of the invention will be further described with reference to the following illustrative Examples.

EXAMPLE 1

A hollow billet with a flat bottom part was cast of steel containing up to 0.15% of carbon, up to 1.0% of manganese, up to 1% of chromium.

The billet outside diameter was 650 mm; its length 2000 mm; thickness of its wall, 100 mm; and thickness of its bottom, 150 mm.

The steel was premelted in an electric arc furnace using slag of the $CaF_2$-$Al_2O_3$ system.

Molten steel and molten slag were teemed into the ladle 25 (FIG. 1) from which they were subsequently poured into the working space 16 of the apparatus for producing a cast hollow billet with a bottom part, the steel weighing 400 kg which constituted 120% of the billet bottom mass.

During pouring the jet was shielded with argon to protect steel from oxidation. The poured steel was blown through in the stationary bottom plate 1 with the mixture of argon and oxygen.

The melting was carried out with solid consumable electrodes, the upward motion of the mould 2 and the mandrel 5 was started immediately upon completion of the pouring which was recorded by the molten metal level gauge 23.

The surface of the produced billet was free of crimps and knobs, the metal was chemically homogeneous, no slag inclusions were detected in the metal, the content of hydrogen did not exceed 0.00025%, of sulphur 0.004%, of non-metallic inclusions 0.006%.

EXAMPLE 2

A hollow billet with a spherical bottom part was cast of steel similar to that described in Example 1.

The billet outside diameter was 650 mm; its length, 2000 mm, thickness of its wall and bottom, 100 mm.

The steel was premelted in an induction furnace, and slag of the $CaF_2$-$CaO$-$Al_2O_3$-$SiO_2$ system was premelted in a slag melting unit.

Molten metal and molten slag were teemed from the induction furnace and slag melting unit into the ladle 25 (FIG. 1) from which they were subsequently poured into the working space 16 of the apparatus for producing a cast hollow billet with a bottom part, the steel weighing 330 kg which constituted 105% of the mass of the billet bottom part. The melting was carried in a manner similar to that described in Example 1.

The surface of the billet produced was free of crimps and knobs. The metal was chemically homogeneous and free of slag inclusions. The content of hydrogen did not exceed 0.0003%; of sulphur, 0.004%; of non-metallic inclusions, 0.005%.

EXAMPLE 3

A hollow billet with a bottom part shaped as a truncated cone was cast according to the embodiment of the apparatus for producing a cast hollow billet with a bottom part shown in FIG. 9 of the steel similar to that described in Example 1. The billet outside diameter was 650 mm; its length, 2000 mm; thickness of its wall, 100 mm; thickness of its bottom, 150 mm.

The steel was premelted in an induction furnace. Slag of the $CaF_2$-$CaO$-$Al_2O_3$-$SiO_2$ system was premelted in a slag melting unit. First, molten slag and them molten steel were poured into the working space 16 of the apparatus for producing a cast hollow billet with a bottom part. The weight of the steel was equal to 240 kg which constituted 80% of the billet bottom weight.

The melting was carried out with solid consumable electrodes, the upward motion of the mould 2 and the mandrel 5 was started immediately upon completion of the pouring which was recorded by the molten metal level gauge 24 (FIG. 9).

The quality of the billet surface was satisfactory, free of crimps and knobs.

The content of hydrogen did not exceed 0.0003%, of sulphur 0.003%, of non-metallic inclusions 0.004%.

EXAMPLE 4

A hollow billet with a bottom the shape of which conforms to the shape of the working surface 16 of the apparatus for producing a cast hollow billet with a bottom part shown in FIG. 7 was cast of steel containing up to 0.20% of carbon, up to 1% of manganese, up to 1% of nickel, up to 0.5% of molybdenum.

The billet outside diameter was 900 mm; its length, 2500 mm; thickness of its walls, 150 mm; thickness of its bottom in the central portion, 250 mm.

The steel was premelted in an induction furnace, slag of the $CaF_2$-CaO-$Al_2O_3$-$SiO_2$ system was premelted in a slag melting unit.

Molten steel and molten slag were teemed into the ladle 25 (FIG. 1).

A dummy bar 33 was placed on the stationary bottom plate 1 (FIG. 7), the dummy bar weighing 480 kg, which constituted 60% of the bottom part mass.

From the ladle 25 (FIG. 1) molten slag and molten metal were poured into the working space 16 of the apparatus for producing a cast hollow billet with a bottom part over the dummy bar, the steel weighing 400 kg which constituted 50% of the bottom part mass. The melting was carried out with a single tubular electrode 20 (FIG. 7), the upward motion of the mould was started by a signal from a molten metal level gauge shown as the gauge 23 in FIG. 1.

The billet has an adequate surface, free of crimps and knobs. There was no trace of junction between the dummy bar 33 and the remainder part of the billet.

The content of hydrogen in the billet metal was not above 0.0003%; of sulphur, 0.004%; of non-metallic inclusions, 0.005%.

EXAMPLE 5

A hollow billet with a flat bottom part was cast of two different steels. The steel used for the bottom part contained up to 0.20% of carbon, up to 0.30% of silicon, up to 0.60% of manganese, thus corresponding to conventional medium-carbon steel. The steel used for the billet walls contained up to 0.15% of carbon, up to 18% of chromium, up to 12% of nickel, up to 4% of silicon, up to 0.5% of titanium, up to 0.5% of aluminium.

The major dimensions of the billet were as follows: outside diameter, 650 mm; length, 2000 mm; wall thickness, 100 mm; bottom part thickness, 150 mm.

Steel having the first of the aforesaid compositions was premelted in an electric arc furnace under slag of the $CaF_2$-$Al_2O_3$ system.

The molten steel and molten slag were poured directly from the electric arc furnace into the working space 16 of the apparatus for producing a cast hollow billet with a bottom part, the steel weighing 335 kg, which constituted 100% of the mass of the billet bottom part.

The melting was carried out with solid consumable electrodes having the second of the aforesaid compositions.

The billet was further used for manufacturing pipes by drawing with subsequent removal of the bottom part.

Compared to the cost of a billet made entirely of the second of the aforesaid steels, the cost of the billet made in the manner described above was reduced by 14%.

The invention is further described with reference to still another illustrative example of carrying out the method for producing a non-split metal workpiece from a solid billet with an expanded top part.

Figure 11:
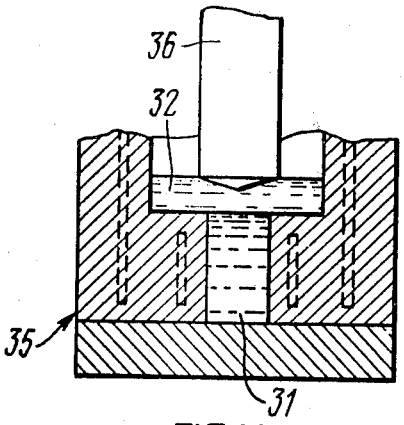
FIGS. 11–14 schematically illustrate embodiments of the method for producing solid billets.

The molten metal 31 and the molten slag 32, premelted in a manner similar to that described above with respect to the method of producing a hollow billet with a bottom part, are poured into the receptacle 35 having its top portion expanded (see FIG. 11) in accordance with prescribed dimensions of the billet. The molten metal 31 is poured in an amount determined by the mass of metal forming the lower and narrower part of the billet.

In producing a solid billet, the process of pouring molten metal and slag may be carried out in the manner similar to that used in the method of production of a hollow billet with a bottom part, namely: pouring slag and then metal seccessively one after the other, pouring the former and the latter simultaneously in one of two different jets, pouring metal and slag over a dummy bar, subjecting the jet of molten metal or the jet of both molten metal and slag to blowing with a neutral gas, and blowing the gas through the molten metal and slag within the receptacle 35.

The optimal variant of pouring is selected in accordance with the requirement imposed upon the metal of a billet, and with consideration for the effect produced by each of the pouring variants described above.

After the molten metal 31 and molten slag 32 are poured into the receptacle 35, electroslag remelting of a consumable electrode 36 is carried out in the slag pool formed therein. The composition of the consumable electrodes 36 is substantially similar to the metal composition specified for the expanded part of the billet, and the mass of said electrode is sufficient for the formation of the billet expanded part. The melted-down metal off the consumable electrode flows upon the poured-in and partially solidified metal, thereby forming with the latter in the process of continuous crystallization a solid billet of a predetermined shape.

Figure 12:
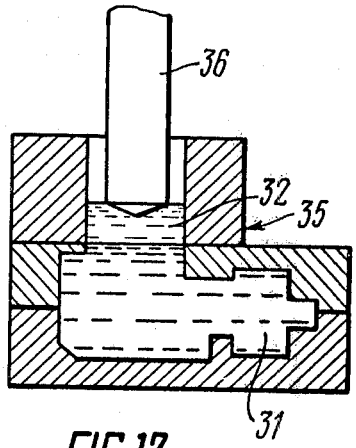
Figure 13:
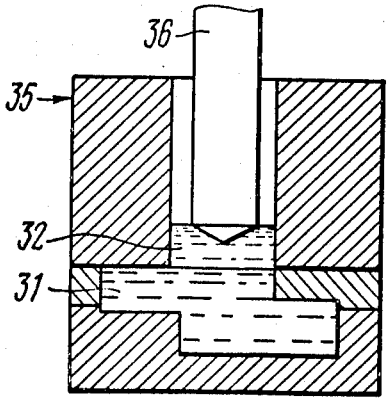
Figure 14:
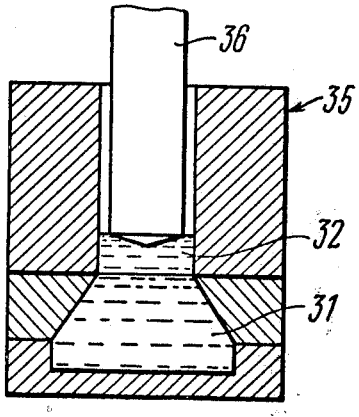

FIGS. 12–14 illustrate other embodiments of the method according to the invention for producing solid billets formed with one or two side branch parts, (see FIGS. 12 and 13, respectively), or with an expanded bottom part, such as shown in FIG. 14. The molten metal being poured is shown throughout the drawings at 31.

EXAMPLE 6

A solid billet was cast from steel containing up to 0.15% of carbon, up to 1% of manganese, up to 1% of chromium. The billet has its upper part expanded in conformity with the shape of the receptacle 35, shown in FIG. 11.

The billet has the following dimensions: the diameter of its expanded part, 900 mm; the diameter of its narrow part, 300 mm; its height, 2500 mm; the height of its narrow part, 700 mm.

The steel was premelted in an electric arc furnace under slag of $CaF_2$-$Al_2O_3$ system. Both the molten steel and slag were simultaneously poured into the receptacle 35 (FIG. 11); the poured-in steel weighed 550 kg which corresponded to the mass of the billet expanded part.

Consumable electrodes of solid cross section were used in the melting process.

The steel of the produced billet has the following content: carbon, not more than 0.0003%; sulphur, 0.003%; non-metallic inclusions, 0.006%.

The metal structure of joint between the expanded and narrow part of the templet manufactured from this billet has been found to be dense and homogeneous.

The method according to the invention allows the production of a wide range of variously shaped billets with the quality of metal comparing favourably with that of the billets produced by the method of electroslag melting. These types of billets are used for the manufacture of such articles as press dies, supporting structures, i.e. columns, stands, brackets and frames, as well as pipes, thick-wall vessels, etc.

With the method of the invention it is also possible to produce non-split articles whose parts are made of different metals.

Apart from ensuring high quality of metal of the articles being produced, the method of the invention is more effective than the known method of producing articles by fusion bonding of ready-made shaped elements to the remainder part produced by electroslag method.

The method according to the invention for producing hollow billets with a bottom part is likewise more effective than the known electroslag method used for the same purpose due to the following advantages, namely:

lower expenses involved in the operations of premelting and pouring the metal required for the bottom part of a billet into a receptacle, as compared with the expenses involved in the production of the same amount of metal by electroslag method;

a lower cost of consumable electrodes due to reduction of their mass by the mass of the poured-in metal;

a higher production rate resulting from a high rate of pouring and from combining the casting of one billet in the electroslag casting unit with a simultaneous premelting of slag and metal for another billet in a suitable unit.

The yield of finished product when producing cast hollow billets according to the invention is on the average 80%.

Hereinabove the specific embodiments of the invention have been disclosed which permit of various adaptations and alterations obvious to those skilled in the art. Other modifications thereof may also be made without departing from the scope of the appended claims.

What is claimed is:

1. A method of producing a metal workpiece having an upper part and a lower base part comprising the steps of:

premelting a metal having the same composition as that specified for the metal of the base part of said workpiece being produced in an amount determined by the mass of metal of the base part of the workpiece;

premelting slag in an amount sufficient to form a slag pool;

pouring the molten slag and molten metal into a receptacle, the molten slag forming a slag pool on top of the molten metal and the molten metal solidifying to produce the base part;

electroslag remelting at least one consumable electrode in the slag pool to produce the upper part, the composition of said electrode being the same as that specified for the metal of the upper part of the workpiece being produced, the mass of the electrode being sufficient to form the upper part of the workpiece being produced.

2. A method according to claim 1, wherein the molten slag and then the molten metal are poured successively into said receptacle.

3. A method according to claim 1, wherein said molten slag and molten metal are poured simultaneously into said receptacle.

4. A method according to claim 1, wherein the molten slag and molten metal poured into said receptacle are blown through with a gas therein.

5. A method according to claim 2, wherein the pouring of molten metal into said receptacle is effected in the atmosphere of neutral gas.

6. A method according to claim 3, wherein the molten metal is poured over a dummy bar positioned at the bottom of said receptacle.

7. A method according to claim 3, wherein the molten slag and molten metal are poured into said receptacle in one and the same jet.

8. A method according to claim 7, wherein the pouring of the molten slag and molten metal in one and the same jet is effected in the atmosphere of neutral gas.

9. A method of producing a hollow billet with a bottom part and a remainder part, comprising the steps of:

premelting a metal having the same composition as that specified for the metal of said bottom part of the billet in an amount determined by the mass of metal of the bottom part being formed;

premelting slag in an amount sufficient to form a slag pool;

pouring the molten slag and molten metal into a receptacle, the molten slag forming a slag pool on top of the molten metal and the molten metal solidifying to produce the base part;

electroslag remelting at least one consumable electrode in the slag pool to produce the remainder part, the composition of said electrode being the same as that specified for the metal of the remainder part of the billet being produced, the mass of the electrode being sufficient to form said remainder part of the billet being cast.

10. A method according to claim 9, wherein said molten metal is poured in an amount of 80 to 120% of the mass of metal required for forming the billet bottom part.

11. A method according to claim 9, wherein the molten metal is poured over a dummy bar positioned at the bottom of said receptacle.

12. A method according to claim 11, wherein the mass total of said dummy bar and the molten metal being poured ranges between 80 and 120% of the mass of the billet bottom part.

13. A method of producing a hollow billet workpiece having a base part comprising:

positioning a mould on top of a bottom plate having a contoured upper surface defining the shape of the bottom of the base part, the mould having outer walls spaced from and surrounding a mandrel, the mould and upper surface cooperating with each other to define a receptacle;

premelting a metal having the same composition as that specified for the metal of the base part of said workpiece being produced in an amount determined by the mass of metal of the base part of the workpiece;

premelting slag in an amount sufficient to form a slag pool;

pouring the molten slag and molten metal into the receptacle, the molten slag forming a slag pool on top of the molten metal and the molten metal solidifying to produce the base part;

electroslag remelting at least one consumable electrode in the slag pool to produce the hollow billet, the composition of said electrode being the same as that specified for the metal of the hollow billet part of the workpiece being produced, the mass of the electrode being sufficient to form the hollow billet part of the workpiece being produced; and moving said mould vertically upward during said electroslag remelting thereby producing said hollow billet part, the slag pool being positioned between the mould walls and mandrel during upward movement of said mould.

14. The method of claim 13 further comprising: sensing the level of the slag pool in said mould; and moving said mould upward when the level reaches a predetermined height in said mould.

15. The method of claim 13 wherein the upward movement of said mould starts as soon as the pouring of the molten slag and molten metal stops.

* * * * *